US005188726A

United States Patent [19]

Jameson

[11] Patent Number: 5,188,726

[45] Date of Patent: Feb. 23, 1993

[54] METHOD OF OPERATING A PLURALITY OF MINERALS SEPARATION FLOTATION CELLS

[75] Inventor: Graeme J. Jameson, New Lambton, Australia

[73] Assignee: University of Newcastle Research Associates Ltd., Australia

[21] Appl. No.: 679,060

[22] PCT Filed: Jul. 26, 1990

[86] PCT No.: PCT/AU09/00313

§ 371 Date: May 3, 1991

§ 102(e) Date: May 3, 1991

[87] PCT Pub. No.: WO91/01809

PCT Pub. Date: Feb. 21, 1991

[30] Foreign Application Priority Data

Jul. 26, 1989 [AU] Australia ..... PJ5448

[51] Int. Cl.[5] ..... B03D 1/02; B03D 1/14

[52] U.S. Cl. ..... 209/164; 209/168; 209/170

[58] Field of Search ..... 209/164, 166, 167, 168, 209/169, 170

[56] References Cited

U.S. PATENT DOCUMENTS

| | | | |
|---|---|---|---|
| 1,022,085 | 4/1912 | Hyde | 209/169 |
| 1,084,196 | 1/1914 | Broadbridge | 209/169 |
| 1,389,674 | 9/1921 | Lyons | 209/169 |
| 1,457,077 | 5/1923 | Janney | 209/169 |
| 1,471,332 | 10/1923 | Greenawalt . | |
| 1,886,979 | 11/1932 | Ruth | 209/169 |
| 1,952,727 | 3/1934 | Ralston | 209/170 |
| 2,226,170 | 12/1940 | Lasseter . | |
| 2,778,499 | 1/1957 | Chamberlain | 209/170 |
| 3,307,790 | 3/1967 | Cohn et al. . | |
| 3;339,730 | 9/1967 | Boutin | 209/170 |
| 4,564,457 | 1/1986 | Cairo, Jr. et al. . | |
| 4,737,272 | 4/1988 | Szatkowski | 209/170 |
| 4,743,379 | 5/1988 | Sugihara et al. . | |
| 4,964,576 | 10/1990 | Datta | 209/169 |
| 4,981,582 | 1/1991 | Yoon | 209/170 |

FOREIGN PATENT DOCUMENTS

| | | | |
|---|---|---|---|
| 62503 | 9/1986 | Australia . | |
| 63047 | 9/1986 | Australia . | |
| 70912 | 3/1987 | Australia . | |
| 1226805 | 3/1971 | United Kingdom | 209/168 |
| 2129714 | 5/1984 | United Kingdom | 209/164 |

*Primary Examiner*—Stanley S. Silverman
*Assistant Examiner*—Thomas M. Lithgow
*Attorney, Agent, or Firm*—Ostrolenk, Faber, Gerb & Soffen

[57] ABSTRACT

A method of operating a plurality of minerals separation flotation cells (1,2) each having a feed inlet (9,14) a values outlet (11) and a gangue outlet (12,15), and each flotation cell being located at substantially the same level. A feed box (3) is located alongside the flotation cells (1,2) which are connected in series such that the outlet (7) from the feed box (3) is connected via a first pump (8) to the feed inlet (9) of a first flotation cell (1), the gangue outlet (12) from the first flotation cell (2) is connected via a second pump (13) to the feed inlet (14) of the next flotation cell (2), and so on until all of the flotation cells are connected in series. Each flotation cell also has a recycle outlet (19) from the lower part of the flotation cell arranged to return a predetermined proportion of the material flowing through that flotation cell to the feed box (3).

5 Claims, 1 Drawing Sheet

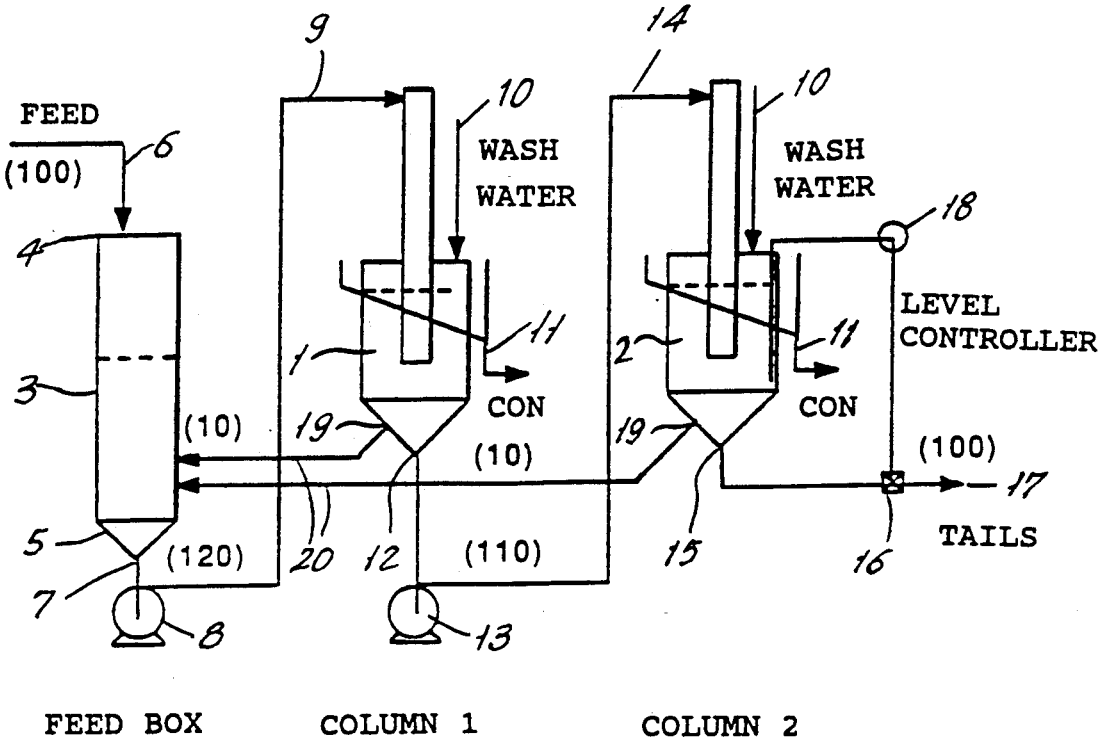
FEED
(100)
6
4
3
5
7
8
(120)
(10)
9
1
10
WASH
WATER
11
CON
19
20
12
(10)
(110)
13
14
2
10
WASH
WATER
11
CON
19
15
18
LEVEL
CONTROLLER
(100)
17
16
TAILS
FEED BOX
COLUMN 1
COLUMN 2

METHOD OF OPERATING A PLURALITY OF MINERALS SEPARATION FLOTATION CELLS

TECHNICAL FIELD

This invention relates to a method of operating a plurality of minerals separation flotation cells.

BACKGROUND ART

In the past minerals separation flotation cells have been used in many applications for the separation of values or concentrate from gangue by mixing the mineral in a slurry or pulp, causing the values or concentrate to be floated to the surface of the pulp in a flotation cell, typically by a bubble inducing operation, recovering the values via an overflow weir, and draining the gangue or unwanted material from the lower part of the cell. Where a high flow rate of product is required it is common to operate a plurality of such minerals separation flotation cells side by side in parallel with one another to achieve the desired output flow rate. In this situation it is necessary to provide each individual cell with a level controller which senses the level of liquid in the cell and controls the flow rate through that particular cell to maintain the desired level range within the cell. This arrangement is expensive in that each cell must be provided with an individual level controller.

There are also situations where it is desired to further refine the gangue or tails which issue from each cell in which case the output from a cell may be redirected back to the input to recycle and reprocess the gangue to retrieve further values or concentrate. Alternatively the gangue from one cell may be directed to another cell for further refinement. These processes disrupt the normal operating cycle of the separation cell resulting in operational inefficiency.

DISCLOSURE OF INVENTION

In one aspect the present invention therefore provides a method of operating a plurality of minerals separation flotation cells (1,2) each having a feed inlet (9,14), a values outlet (11), and a gangue outlet (12,15), and each flotation cell being located at substantially the same level, said method comprising the steps of providing a feed box (3) located alongside the flotation cells and adapted to contain feed liquid over the operating height level range of the flotation cells, connecting the flotation cells in series such that the outlet (7) from the feed box is connected via a pump (8) to the feed inlet (9) of a first said flotation cell, the gangue outlet (12) from the first flotation cell (1) is connected via a pump (13) to the feed inlet (14) of the next flotation cell and so on until all said flotation cells are connected in series, each flotation cell also having a recycle outlet (19) from the lower part of the flotation cell arranged to return a predetermined proportion of the material flowing through that flotation cell to the feed box (3).

Preferably the gangue outlet from the last cell is controlled by a control valve controlled by a level controller actuated by the level of liquid in the last cell.

Preferably each said pump is sized to provide the desired proportional flow rate between the gangue outlet from each cell and the recycle outlet to the feed box.

In a further aspect the invention provides apparatus for minerals separation comprising a plurality of minerals separation flotation cells (1,2) each having a feed inlet (9,14), a values outlet (11) and a gangue outlet (12,15), each cell being located at substantially the same level, a feed box (3) having an inlet (4) and outlet (7) and being located alongside the flotation cells and adapted to contain feed liquid over the operating height level range of the flotation cells, the flotation cells being connected in series such that the outlet (7) from the feed box (3) is connected via a pump (8) to the feed inlet (9) of the first said flotation cell, the gangue outlet (12) from the first flotation cell is connected via a pump (13) to the feed inlet (14) of the next flotation cell and so on such that all said flotation cells are connected in series, each flotation cell also having a recycle outlet (19) from the lower part of that flotation cell communicating with the feed box (3).

Notwithstanding any other forms that may fall within its scope, one preferred form of the invention will now be described by way of example only with reference to the accompanying drawing which is a diagrammatic elevation of two minerals separation flotation cells arranged in series for operation according to the present invention.

BRIEF DESCRIPTION OF DRAWING

The accompanying drawing shows only two minerals separation flotation cells connected in series although it will be appreciated that three or more cells could be connected in series in the same manner as desired.

MODES FOR CARRYING OUT THE INVENTION

The minerals separation cells (1) and (2) are located side by side at the same level and a feed box (3) is provided located alongside the cells and adapted to contain feed liquid over the operating height level range of the flotation cells. In this regard the feed box would normally extend from a high point (4) higher than the top of the cells (1) and (2) to a drain point (5) lower than the bottom of the flotation cells.

The feed box and the cells are connected in series such that the feed material in the form of a pulp or slurry is introduced into the feed box at (6) and passes via an outlet (7) and pump (8) to an interconnection (9) into the top of the separation cell (1). Each separation cell is typically provided with wash water at (10) and a values or concentrate outlet at (11). The gangue from the first cell (1) drains via a gangue outlet (12) to a pump (13) which is connected in turn via connection (14) to the inlet of the second (and in this case last) cell (2). The gangue outlet (15) from the last cell (2) is connected via a control valve (16) to a tails outlet (17). The control valve (16) is operated by a level controller (18) connected to a float valve or other level sensing device within the cell (2) to operate the outlet valve (16) to maintain the level of liquid within the cell (2) over a predetermined range.

In an alternative form of the invention, each cell (or selected cells) may be provided with their own level controllers connected to a float valve or other level sensing device within that cell and operating a valve in the gangue outlet.

Each cell is provided with a recycle outlet (19) arranged to return a predetermined proportion of the material flowing through that cell to the feed box (3) via connections (20). The proportion of recycled material passing through the connections (20) compared with that passing through the gangue outlets (12) and (15) is controlled by the sizing of the pumps, e.g. for cell (1) by the size of pump (13). In the example shown in the drawing, typical flow rates in liters per minute are shown in brackets alongside relevant conduits. It can be seen for example that pump (13) is sized to give a flow rate of 110 liters per minute whereas pump (8) from the feed box has a flow rate of 120 liters per minute. Presuming that the flow rate of the wash water entering the cell at (10) and the output of concentrate at (11) are the same, then the flow rate of gangue returned to the feed box via connection (20) is 10 liters per minute.

The system is sized to cope with the maximum flow rate expected, but for operating flow rates below the maximum, stable operation is maintained by changes in the internal recycles. Backward recycle of pulp (back into the feed box rather than forward to the tails) is ensured by correct sizing of the pumps as described above.

The method of operating a plurality of minerals separation flotation cells as described has the advantage that it is only necessary to use one level controller (18) for a plurality of cells and it is also possible to use fixed speed pumps (8) and (13) as the flow rate does not need to be controlled by varying pump speed. Once again a considerable saving in capital equipment can be achieved.

A further advantage is that a controllable percentage of the pulp is recycled (for example 10/120 of the pulp from the first cell is recycled in the example given above) which enables the pulp to be refined to a predetermined degree beyond the normal refinement which would be achieved by simply passing the pulp in series through the same number of minerals separation flotation cells.

I claim:

1. A method of operating and controlling the level of pulp in a plurality of minerals separation flotation cells (1,2) each having a feed inlet (9,14), a values outlet (11), and a gangue outlet (12,15), and each flotation cell being located at substantially the same level, said method comprising the steps of providing a feed box (3) located alongside the flotation cells and adapted to receive feed liquid over a predetermined range of flow rates and to contain feed liquid over the operating height level range of the flotation cells, feeding said feed liquid to said feed box at a rate within said predetermined range of flow rates, connecting the flotation cells in series such that the outlet (7) from the feed box is connected via a pump (8) to the feed inlet (9) of a first of said flotation cells, the gangue outlet (12) from the first flotation cell (1) is connected via a pump (13) to the feed inlet (14) of the next flotation cell and so on until all of said flotation cells are connected in series, operating each pump at a capacity greater than the highest predetermined flow rate of feed liquid to said feed box and recycling a predetermined proportion of the material flowing through each flotation cell to the feed box (3) through a recycle outlet (19) located at the lower part of each flotation cell.

2. A method of operating a plurality of minerals separation flotation cells as claimed in claim 1, wherein the flow rate of gangue outlet from the last flotation cell in the series is controlled by a control valve (16) in turn controlled by a level controller (18) actuated by the level of liquid in the last flotation cell.

3. A method of operating a plurality of minerals separation flotation cells as claimed in claim 1, wherein the flow rate through the gangue outlet from two or more said flotation cells is controlled by a control valve controlled by a level controller actuated by the level of liquid in that flotation cell.

4. A method of operating a plurality of minerals separation flotation cells as claimed in claim 1, wherein each said pump (8,13) is sized to provide the desired proportional flow rate between the gangue outlet (12,15) from each flotation cell and the recycle outlet (19) to the feed box.

5. A method of operating a plurality of minerals separation flotation cells, as claimed in claim 1, wherein at least some of the flotation cells are provided with a wash water inlet (10) and wherein the flow rate of wash water entering each such flotation cell is approximately the same as the flow rate of values (11) from that flotation cell.

* * * * *